United States Patent [19]

Polin et al.

[11] Patent Number: 5,038,526

[45] Date of Patent: Aug. 13, 1991

[54] METHOD AND APPARATUS FOR PROFILING

[76] Inventors: Ronald E. Polin, 37908 North Laurel Park Dr., Livonia, Mich. 48152; Keith C. Subjeck, 14711 Gary La., Livonia, Mich. 48154

[21] Appl. No.: 555,935

[22] Filed: Jul. 20, 1990

[51] Int. Cl.[5] ..... B24B 23/00

[52] U.S. Cl. ..... 51/281 R; 51/59 R; 51/170 TL

[58] Field of Search ..... 51/281 R, 281 P, 170 TL, 51/175, 59 R, 55, 327, DIG. 2, 57

[56] References Cited

U.S. PATENT DOCUMENTS

| | | | |
|---|---|---|---|
| 3,007,230 | 11/1961 | Riedl | 51/170 TL |
| 3,763,531 | 10/1973 | Dancsik | 51/170 TL |
| 3,867,747 | 2/1975 | Lee | 29/76.4 |
| 3,953,944 | 5/1976 | Olson | 51/170 TL |
| 4,512,207 | 4/1985 | Dancsik | 51/170 TL |

FOREIGN PATENT DOCUMENTS

| | | | |
|---|---|---|---|
| 3702937 | 8/1988 | Fed. Rep. of Germany | 51/170 TL |
| 0673602 | 6/1952 | United Kingdom | 51/170 TL |

*Primary Examiner*—Robert A. Rose

*Attorney, Agent, or Firm*—Barnes, Kisselle, Raisch, Choate, Whittemore & Hulbert

[57] ABSTRACT

A method and a tool adapter for removing tool marks and smoothing die and mold surfaces which includes a pre-existing profiling tool with an eccentric output, an adapter tool for the output, and an abrasive stone to be hand held while in contact with the adapter tool to reciprocate and apply a metal removing action to the die or mold.

3 Claims, 1 Drawing Sheet

METHOD AND APPARATUS FOR PROFILING

FIELD OF INVENTION

In the manufacture of dies and molds used in plastic or metal forming, a method and tool adapter for smoothing surfaces and removing tooling marks.

BACKGROUND AND OBJECTS OF THE INVENTION

In the making of metal forming dies for the manufacture of molded plastic and metal parts such as automotive interior and exterior trim, for example, it is common to utilize a contour machining tool which can be computer controlled to shape solid metal pieces to conform to the desired contour for the part to be formed. However, the machining process leaves tool marks on the surface of the contour which must be smoothed out prior to applying a high polish on the contour.

These tool marks and irregularities have been removed by using a power tool holding an abrasive stone which an operator can apply to the surface to be smoothed, the stone being reciprocated by the power tool as it is held against the work.

The present invention is directed also to a hand operation but an adapter tool is carried by the power tool with an end recess to engage a hand held stone rod, one end of which is held by the operator and the other end applied manually against the surface to be treated. The result is a smoother surface achieved in less time. The skilled operator can manually direct the stone at the areas where metal removal is needed and the power tool will provide the reciprocal action needed for metal removal.

An object of the invention is to provide a method of profile smoothing which can be applied to intricate curves and recesses as well as to flat areas to obtain a fine smooth surface.

A further object is the provision of an adapter tool, power assisted, to be held against a stone for the needed motion while guided manually.

Other objects of the invention will be apparent in the following description and claims in which the invention is described, together with details to enable a person skilled in the art to practice the invention all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
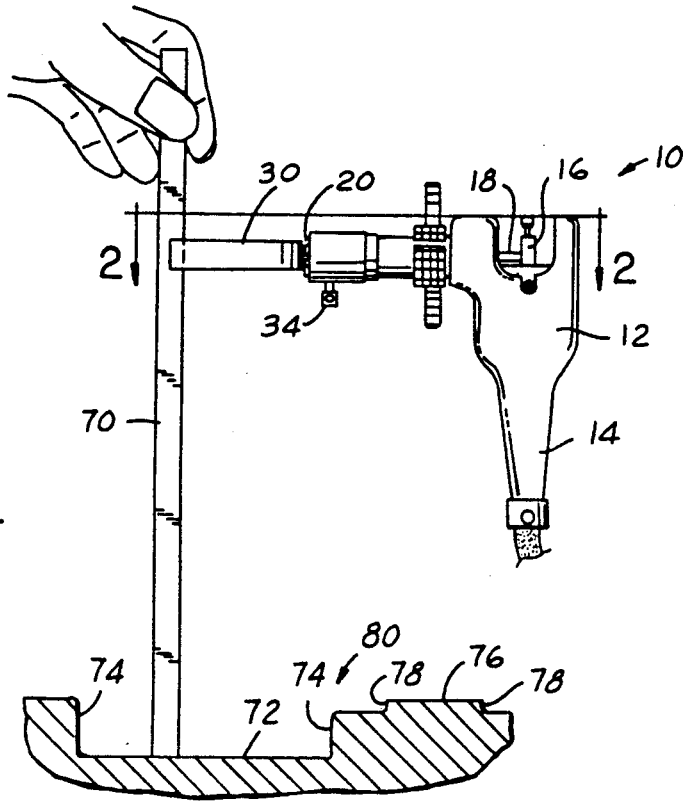
FIG. 1, a view showing the method of operation.

In FIG. 1, a profiler mechanism is illustrated at 10. A housing 12 has a handle 14. A main drive assembly in the handle drives a coupling pin 16 which is eccentrically mounted to reciprocate a drive shaft 18. This drive shaft reciprocates a tool holder 20 which has a central recess to receive a shaft of a tool. This mechanism will have a stroke adjustment and a speed adjustment. As an example, for a short or medium stroke up to 0.120" (3 mm), a high speed may be used. For a full stroke up to 0.200" (5 mm), medium speeds can be used. This type of mechanism is sold by DME Company, a Fairchild Industries Company, under the trademark DME Jiffy Super Profiler. A similar vibratory tool is shown in Riedl, U.S. Pat. No. 3,007,320 (1961).

The present invention involves the use of an adapter tool which is elongate, perhaps three or four inches, and has a cross-section which can be rectangular or round, for example, and which can be made preferably of a dense polyurethane material. At one end of the adapter tool 30 is a bit 32, (See FIGS. 5 to 8), which is to be received in the central recess of tool holder 20. A set screw 34 can lock the adapter tool in the recess. FIGS. 5 to 8 show various ways of locking the bit in the end of the adapter tool by a threaded end, a knurled end, a splined end 40, and a flared end 42. The polyurethane can be molded or cast around these bit ends. If metal is used for the adapter tool, the material can receive a press fit bit end or be forged around the flared end. It is important that the bit 32 be securely received and retained in the adapter tool 30 since it is subject to rapid vibration and reciprocation.

Figure 2:
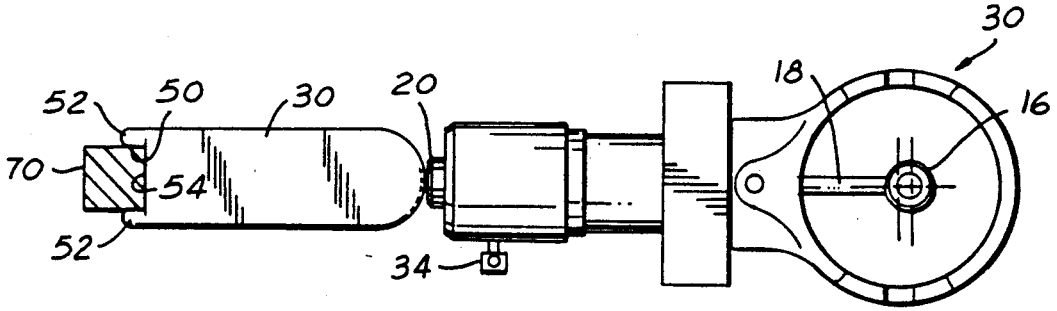
FIG. 2, a plan view of a profiler tool.

The end of the adapter tool 30 opposite the bit end is formed with a recess 50 as shown in FIG. 2. The recess is formed by two wings 52 on opposite sides of a flat back wall 54. This recess 50 is provided to receive the side of an elongate abrasive tool such as an abrasive stone or file.

Figure 3:
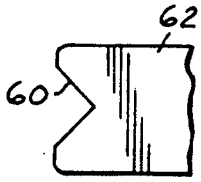
FIG. 3, a first modification of an adapter tool.
Figure 4:
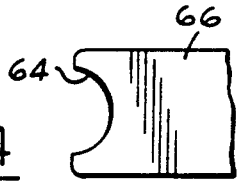
FIG. 4, a second modification of an adapter tool.
Figure 5:
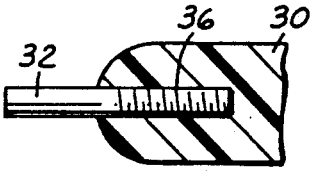
FIGS. 5 to 8, similar illustrations of retention means for bits in an adapter tool.
Figure 6:
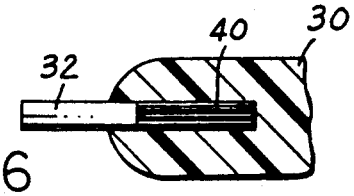
Figure 7:
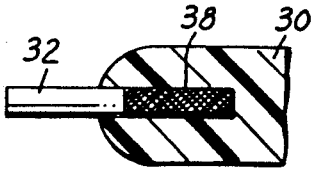
Figure 8:
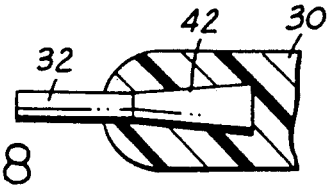

Various sizes and shapes of stones and files may be used and the recess in the distal end of the adapter tool 30 is preferably designed to fit a particular stone being used. In FIG. 3, a triangular recess 60 is illustrated in a block 62. In FIG. 4, a semi-circular recess 64 is formed in a block 66.

In FIG. 1, a stone shaft 70 is illustrated, one end being held by an operator's hand and the other end being placed against the surface of a die 80. The dies may have any number of curves or recesses which have to be smoothed and polished. Thus, various shapes of stones may be used, from small to large, and triangular, square or round. The die example shown in FIG. 1 has a recess with a base 72 and filleted side walls 74. Also, a shallow rib 76 must be treated again with filleted sides 78.

The bit 32 of the adapter tool 30 is secured in the bit recess of the tool 10 and locked in by the set screw 34. An operator then grasps the profiler tool 10 and the top end of the stone 70 and sets the stone in the end recess of the adapter tool 30. With a proper speed and vibratory amount, the working end of the stone or file vibrates on the die or mold surface and smooths out the tool marks and imperfections. A skilled operator has much better control of the abrasive tool and he can move and tilt the stone or file to achieve a desired result. The stone can be grasped either at the top end or below the adapter tool, whichever is most convenient for the operator.

Thus, the invention lies in the method of smoothing dies or molds by a hand held stone held against a vibratory source and applied to the surface to be abraded and smoothed. The invention lies also in the adapter tool in combination with the reciprocating tool which imparts the vibratory forces to the abrasive stone.

What is claimed is:

1. A method of smoothing out machining marks and imperfections in a die or mold surface which comprises:

(1) providing a vibrator source with a bit opening, (2) providing an adapter tool mounted in said bit opening, (3) manually holding a first end of an elongate abrader tool while applying a second opposite end of said abrader tool against a die or mold surface to be worked, (4) selectively positioning said adapter tool along said abrader tool and urging said adapter tool against said manually held abrader tool to cause said abrader tool to vibrate, and (5) manually guiding said abrader tool along said die or mold surface while maintaining contact with said vibrating adapter tool.

2. A method as defined in claim 1 which includes the step of providing a recess in said adapter tool to receive one side of the first end of said abrader tool to assist in manual positioning of said first end in said adapter tool for manual control of said tool during vibration of said vibrator source and said abrader tool.

3. An apparatus for smoothing out machining marks and imperfections in a die or mold surface which comprises:

(a) a vibratory source having a reciprocating output fixture with a bit opening, (b) an adapter tool having a bit at one end to be received and locked in said bit opening, means on said adapter tool for manually guiding an elongate abrader tool, said manual guide means comprising a guide recess in an outer distal end opposite said bit end, and selectively positionable along said elongate abrader and (c) an abrader tool to be manually placed and manually retained in said guide recess in a position substantially normal to the vibratory action of said vibratory source, said abrader tool being manually held and manipulated in contact with a work surface.

* * * * *